United States Patent [19]

Milam

[11] Patent Number: 4,766,663

[45] Date of Patent: Aug. 30, 1988

[54] METHOD OF ATTACHING MEMBER TO A TUBULAR STRING

[76] Inventor: Jack J. Milam, 2217 Lane Way Cir., Oklahoma City, Okla. 73159

[21] Appl. No.: 6,472

[22] Filed: Jan. 21, 1987

Related U.S. Application Data

[62] Division of Ser. No. 766,644, Aug. 16, 1985, Pat. No. 4,658,896.

[51] Int. Cl.[4] ..... B21D 39/00

[52] U.S. Cl. ..... 29/455.1; 29/460; 29/525.1; 156/295; 264/262; 403/266

[58] Field of Search ..... 29/455 R, 460, 526 R; 403/266; 156/295, 92; 166/241; 264/262

[56] References Cited

U.S. PATENT DOCUMENTS

| | | | |
|---|---|---|---|
| 2,659,439 | 11/1953 | Baker | 166/4 |
| 2,973,996 | 3/1961 | Self . | |
| 3,072,195 | 1/1963 | Kluck | 166/241 |
| 3,360,846 | 1/1968 | Schellstede et al. | 29/447 |
| 3,439,075 | 4/1969 | Bauer et al. | 264/262 X |
| 3,818,999 | 6/1974 | Garrett | 175/325 |
| 3,918,519 | 11/1975 | Cubberly, Jr. | 166/241 X |
| 3,938,853 | 2/1976 | Jurgens | 166/241 X |
| 4,028,796 | 6/1977 | Bergstrom | 29/416 |
| 4,101,179 | 7/1978 | Barron . | |
| 4,105,262 | 8/1978 | Richey . | |
| 4,141,386 | 2/1979 | Bergstrom | 138/147 |
| 4,143,713 | 3/1979 | Kreft | 166/241 |
| 4,171,560 | 10/1979 | Garrett | 29/455 R |
| 4,206,808 | 6/1980 | Kreft | 166/241 |
| 4,219,081 | 8/1980 | Howe | 166/241 |
| 4,219,980 | 9/1980 | Loyd | 403/266 X |
| 4,275,935 | 6/1981 | Thompson | 166/241 X |
| 4,286,898 | 9/1981 | Stafford | 29/460 X |
| 4,434,125 | 2/1984 | Lavender et al. | 264/262 |
| 4,436,158 | 3/1984 | Carstensen | 29/460 X |
| 4,458,404 | 7/1984 | Garrett | 29/460 X |

OTHER PUBLICATIONS

Publication of Halliburton Oil Well Cementing Co. entitled "Co-Axial Spiral".
Publication of Houston Pipe Appliance Company entitled "Hall's Spiral Casing Guide".
Publication of Larkin Packer Company, Inc.
Publication of Petroleum Equipment Company, Ltd., disclosing "Pecol Stop Rings".
Publication of GEMOCO disclosing use of set screws.
Publication of Petroleum Equipment Company, Ltd.
Publication of Regal Oil Field Products.
Publication of B&W, Incorporated.
Publication of Weatherford Cementation Equipment.
Publication of SMFI.
Publication of Regan Forge & Engineering Company.

*Primary Examiner*—Charlie T. Moon
*Attorney, Agent, or Firm*—Laney, Dougherty, Hessin & Beavers

[57] ABSTRACT

A centralizer apparatus having turbolizer protuberances includes groups of openings for receiving set screws to define a plurality of circumferential and longitudinal points of engagement between the centralizer and a tubular string to which it is attached. Associated with the centralizer is a bonding layer of adhesive material, which is injected through one of the openings while the centralizer is rotated relative to the tubular string to obtain a rigid bond between an outer surface of the tubular string and a majority of the inner surface of the centralizer. The bond can be broken by the external application of heat so that, after also loosening the screws, the centralizer can be removed from the tubular string.

10 Claims, 1 Drawing Sheet

METHOD OF ATTACHING MEMBER TO A TUBULAR STRING

This is a divisional of co-pending application Ser. No. 766,644 filed on Aug. 16, 1985, now U.S. Pat. No. 4,658,896.

BACKGROUND OF THE INVENTION

The present invention relates generally to apparatus attachable to a tubular element and method of attaching the same and more particularly, but not by way of limitation, to a centralizer for a flush-joint liner and method of utilizing the same in disposing the liner in an oil or gas well for enhancing the flow of cement therealong once the liner is positioned in the well.

In drilling and completing oil and gas wells, casing is often installed to line the well bore. Sometimes a liner is also installed. The liner usually has a smaller diameter than the casing and is often of a flush-joint construction (i.e., there are no outwardly protruding collars at the joints of the liner) so that the liner can be readily lowered into the bore through the casing after the casing has been set. In this configuration, the liner partially overlaps with the casing, but otherwise it extends below the casing into a deeper region of the well.

To fix the casing or the liner in the well bore, cement is pumped down the central opening through the tubular string defining the casing or liner and back up the annulus between the outside of the string and the wall of the well bore. To space the string from the wall and to scrape the wall to insure the annulus is open around the entire string, centralizer apparatus are attached to the string prior to lowering it into the well. It is important to have the annulus open so that the cement does not channel along only part of the outside of the string, which channeling results in an improper bond whereby leaks between the bore and the string can occur. Such leaks can allow fluid to uncontrollably escape to the surface, thereby possibly creating a hazardous situation; or the leaks can allow communication of fluids between geological zones, thereby possibly detrimentally contaminating one zone with fluid from another. In addition to, or in lieu of, the use of centralizers, sometimes a liner is rotated or reciprocated during a cementing job to prevent channeling; however, this requires more sophisticated couplings between the liner and the pipe string on which the liner is run into the hole. Therefore, it is more economical if suitable centralizers can be used without requiring reciprocation or rotation to properly cement the liner.

Various types of centralizer apparatus are well known in the oil and gas industry. Some principally maintain the tubular string in a central location within the bore as the string is lowered into the bore, and others perform this centralizing function as well as scraping debris, such as wall cake, from the wall of the well bore. Some types of centralizer apparatus also are constructed with components which impart a turbulence to the cement flow so that the cement flows around the entire string as well as along it. These last types are sometimes referred to as turbolizers or turbulence-generating centralizers.

Various techniques to attach a centralizer apparatus to a string are known. The attachment of a centralizer apparatus to a string is important so that the centralizer does not come loose in the well bore and slip off a flush-joint liner, for example, into the flow path of the upper casing thereby obstructing the flow path. In the past and at present, centralizer attachment has been by a structural type of attachment, such as welding, or by a mechanical clamping technique, such as by tightening a few screws disposed around a single circumference of the centralizer or by hydraulically or pneumatically inflating a flexible element of a stop member associated with the centralizer or by pinning or bolting a split ring type of construction into engagement with the string or by mechanical stop elements retained adjacent ends of the centralizer by clamping or wedging mechanisms.

Although these various techniques have been, and currently are being, used, none has proved entirely or universally acceptable because they are either time consuming to install and not readily removable (such as with the welding technique) or they tend to come loose as the tubular string is being lowered into the well bore (such as with the mechanical clamping types of techniques). The loosening or slippage problem is particularly significant in relatively deep holes in which liners are used because higher pressures exerting forces exceeding the holding capacity of the prior art techniques can be encountered.

Therefore, there is the need for an apparatus readily attachable to, and preferably subsequently readily removable from, a tubular string so that the apparatus will not come off in the high pressure environments before they are intended to come off. There is also the need for a method of attaching these apparatus and of removing the apparatus. More specifically, there is the need for an improved centralizer apparatus for a flush-joint liner and a method of attaching the same so that it will not come off in response to forces encountered in the well bore, such as from high pressures or movement of the string.

SUMMARY OF THE INVENTION

The present invention overcomes the above-noted shortcomings of the prior art by providing a novel and improved apparatus attachable to a tubular string and a method of attaching the same. More specifically, the present invention provides a cement flow-enhancing centralizer apparatus and method of attaching and subsequently removing the same. In a preferred embodiment, the present invention readily attaches the apparatus to the tubular string with a construction and in a manner by which the apparatus does not move relative to the tubular string in response to high pressures encountered in a well bore. Also in a preferred embodiment, the present invention is used with a flush-joint liner.

The preferred embodiment apparatus of the present invention is of the type which enhances the flow of cement along a flush-joint liner, in the preferred embodiment, and which provides a centralizer for a tubular string. This apparatus broadly includes a collar or cylindrical sleeve having an inner surface disposed around, but spaced from the tubular string when the apparatus is disposed thereon. This inner surface has an inner diameter greater than the outer diameter of the tubular string so that an annulus is defined between the apparatus and the tubular string. The apparatus also includes a plurality of protuberances extending from the collar or sleeve. The apparatus still further includes first connector means for connecting the collar or sleeve to the tubular string. The first connector means includes a plurality of sets of screws; these are retained through at least the collar or sleeve or through suitable collar stops of types known to the art and disposed adjacent the ends of the collar or sleeve of the present apparatus. Each set of screws has a plurality of screws substantially linearly aligned. The apparatus also includes second connector means for providing a bond between an outer surface of the tubular string and at least a majority of the area of the inner surface of the collar or sleeve or of the area of the collar stops if they are used. The second connector means includes injection means for injecting an adhesive material into the annulus for providing a layer rigidly bonding the collar or sleeve to the tubular string or into similar annuluses between collar stops and the tubular string.

The method of the present invention broadly comprises disposing the collar or sleeve around the tubular string to define the annulus and injecting an adhesive substance into the annulus for rigidly bonding the sleeve and the tubular string. Alternatively, the adhesive substance is injected to bond collar stops to the tubular string so that the collar or sleeve is longitudinally, but not rotationally, fixed relative to the string. The method further comprises rotating the sleeve (or collar stops) relative to the tubular string while injecting the adhesive material. The method also includes tightening a plurality of screws through the sleeve (or collar stops) into engagement with the tubular string. In the preferred embodiment the method also comprises heating the adhesive layer and sliding the centralizer off of the liner after the adhesive layer has been heated and the screws loosened.

Therefore, from the foregoing, it is a general object of the present invention to provide a novel and improved apparatus and method for attaching an object, such as a centralizer, to a tubular string, such as a flush-joint liner, so that the object does not move at least longitudinally relative to the tubular string as the tubular string is lowered into a well bore. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENTS

The following description of the preferred embodiments will be made with reference to the environment of a centralizer apparatus attached to a flush-joint liner; however, other devices, such as drilling stabilizers, can be attached by the method of the present invention.

Figure 1:
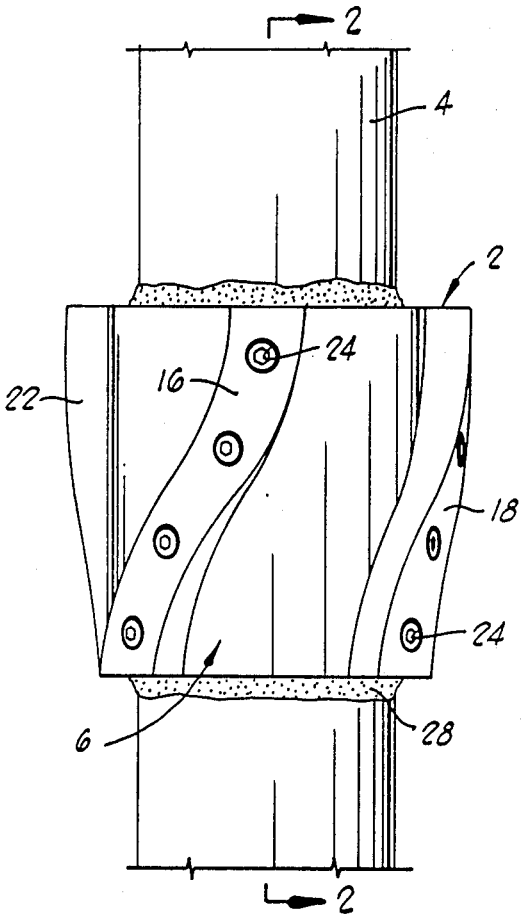
FIG. 1 is an elevational view of a first preferred embodiment of the apparatus of the present invention shown attached to a tubular string.

FIG. 1 of the drawings shows an apparatus 2, constructed in accordance witha first preferred embodiment of the present invention, attached to a tubular string 4, such as a flush-joint liner of a type as known to the art. The apparatus 2 includes a centralizer, first connector means for providing a first connection between the centralizer and the tubular string 4, and second connector means for providing a bond between an outer surface of the tubular string 4 and a majority of the area of an inner surface of the centralizer.

The centralizer includes a circumferentially continuous or solid (i.e., non-split) collar or sleeve 6 having a cylindrical shape with a hollow interior extending axially therethrough. The collar or sleeve 6 has an inner surface 8, an outer surface 10, and an end surface 12 spaced longitudinally from an end surface 14. The collar or sleeve 6 is made of a suitable metal of a type as known to the art.

Extending radially outwardly from the outer surface 10 of the collar 6 is a plurality of protuberances which can be referred to as turbulizer blades or wings for scraping the well bore or casing as the tubular string 4 and centralizer are lowered into the well and for imparting turbulence to a cement slurry used to cement the tubular string in the well, both being well-known functions of such elements. These protuberances are identified in FIGS. 1 and 2 by the reference numerals 16, 18, 20, 22. These four protuberances are made of metallic segments or strips welded to the outer surface 10 of the collar 6 at spaced intervals around the circumference thereof. Each segment extends at an oblique angle relative to the ends 12, 14. That is, the segments do not extend longitudinally in perpendicular relationship to the end surfaces 12, 14.

Figure 2:
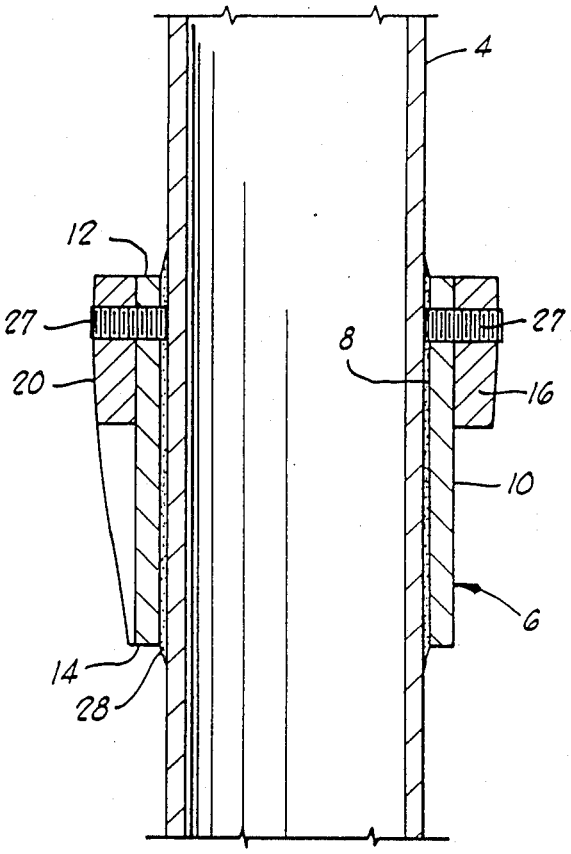
FIG. 2 is a sectional elevational view of the embodiment shown in FIG. 1 as taken along line 2—2.

In the preferred embodiment shown in FIGS. 1 and 2, each protuberance has a plurality of threaded openings or holes 24 spaced along and defined therethrough. These openings 24 are radially aligned with openings or holes through the collar or sleeve 6. These openings are formed for receiving retaining screws forming a part of the first connector means. By disposing the holes 24 in the protuberances as in the embodiment of FIGS. 1 and 2, there is more supporting material for the screws, which is important when the centralizer is to be constructed with a thin collar or sleeve 6 as is required in some close-tolerance applications.

Figure 3:
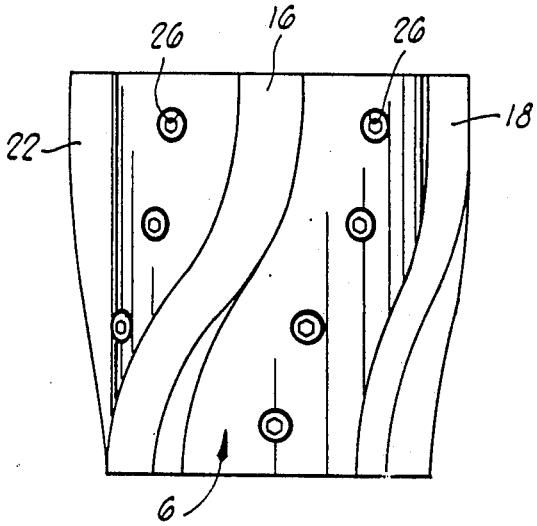
FIG. 3 is an elevational view of a second preferred embodiment of the apparatus of the present invention.
Figure 4:
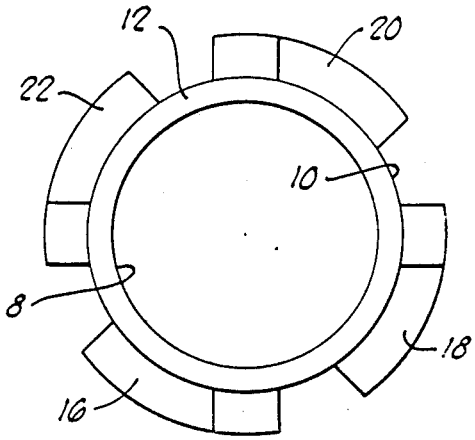
FIG. 4 is an end view of the preferred embodiment shown in FIG. 3.

Although the holes 24 are defined in the protuberances of the first-described embodiment, it is contemplated that they can be disposed in the collar 6 between the protuberances as shown in the embodiment of FIGS. 3 and 4. In this other embodiment, the holes are identified by the reference numeral 26. There are four groups of four holes in the second embodiment, just as in the first embodiment; however, the holes 26 of the second embodiment are disposed only through the collar 6. This disposition is the only difference between the two illustrated embodiments; therefore, like reference numerals are used in FIGS. 3 and 4 to identify like elements between the two embodiments.

In both of the illustrated embodiments, the holes 24 or 26 are in offset, substantially linear association within each set. The substantially linear association is along a line extending at an oblique angle relative to the ends 12, 14 of the collar 6. By using more than one hole within each set and circumferentially and longitudinally offsetting the holes within each set, the engagement area provided between the ends of the screws and the outer surface of the tubular string 4 is larger than in prior art connectors using only a single ring of four screws spaced around the circumference of such prior art centralizers. This offset construction prevents a single line of engagement as is used in those prior art techniques having set screws disposed along a single circumferential line of the centralizer. This provides a stronger engagement to oppose the torque which can be exerted between the collar 6 and the tubular string 4 as the string 4 is lowered into the well bore. It is this construction of utilizing a plurality of sets of openings, each of which sets includes two or more openings associated together at an oblique angle between the ends of the collar 6, which is one distinction between the centralizer of the present invention and the types of prior art centralizers known to me. Furthermore, the disposition of the openings through the turbulizer blades or wings, themselves, is not known by me to have been used in the prior art. Otherwise, the constructions of the collar 6 and the four protuberances are of types as known to the art.

The first connector means by which the centralizer is in part connected to the tubular string 4 by a first engagement force includes in the preferred embodiment sixteen set screws 27 threadedly engageable with the respective sixteen holes 24 defined as the four sets of holes in the four protuberances. Each of these set screws is of a type as known to the art and constructed for achieving a suitable engagement with the outer surface of the tubular string 4.

The second connector means by which a rigid bond establishing a second engagement force is provided between the inner surface 8 and the outer surface of the tubular string 4 includes a layer 28 of adhesive substance. The adhesive substance is any suitable bonding material, such as threadlock material of a type as known to the art or a liquid metal compound or other suitable epoxy or glue. Types of threadlock which have been used include those sold under the names of Baker and GEMOCO. In the preferred embodiment the material is of a type which dries or cures to form a rigid bond, but which can be loosened by the application of heat at a suitable temperature. The rigid bond formed by the adhesive substance couples the centralizer to the tubular string 4 so that the two are immovable, both longitudinally and rotationally, relative to each other in response to forces, such as from pressures or movements, which might be encountered in the well bore when the tubular string 4 is disposed therein. In the preferred embodiment the substance is of a type that forms a rigid bond or coupling which, in association with the tightened set screws 27, has been tested to withstand forces up to approximately 30,000 pounds. That is , the first and second engagement forces of the two connector means of the preferred embodiment combine to withstand a force up to approximately 30,000 pounds. At least one test has indicated that these combined engagement forces can withstand a force of up to approximately 120,000 pounds. Of course, the force-withstanding capacity of the present invention can be varied for specific constructions, such as by changing the area over which the adhesive forms its bond.

To apply the adhesive layer, the second connector means of the preferred embodiment includes injection means for injecting the adhesive substance. This injection means of the preferred embodiment is a caulking-type gun which can be coupled with one of the holes 24 defined in the centralizer, such as with an externally threaded nozzle forming part of the caulking-type gun. The caulking-type gun includes a chamber for receiving a cannister or other container of the adhesive substance in a suitable manner. As shown in FIGS. 1 and 2, the material forms a bond over a majority of the area of the inner surface 8 and the facing portion of the outer surface of the member of the tubular string 4.

By the method of the present invention, an object can be rigidly connected to a tubular string so that the connection does not yield to pressure which can be encountered within the well bore. With respect to the preferred embodiment, this method includes disposing the collar or sleeve 6 around a tubular member forming a section of the tubular string 4. For example, the collar 6 can be implaced by slipping the collar 6 over an end of the tubular member and sliding it along the length of the member to the location at which it is to be connected. When the collar 6 is so disposed, an annular space is defined between the inner surface 8 and the tubular member for receiving the layer 28 of material.

The method also comprises injecting the adhesive substance into the space to rigidly bond the sleeve 6 and the tubular member. In the preferred embodiment the step of injecting includes attaching the caulking-type gun to one of the holes 24 (or 26) and actuating the caulking-type gun to eject the adhesive substance so that the substance flows into the annular space thereby forming the bonding layer for maintaining a rigid connection.

To insure that the adhesive substance is uniformly distributed throughout the annular space, the method of the preferred embodiment includes rotating the sleeve 6 relative to the tubular member while injecting the adhesive material.

The method further comprises tightening the plurality of screws through the sleeve 6 into engagement with the tubular member to provide a further connecting force.

For removing the centralizer from the tubular member, the preferred embodiment of the method further includes heating the adhesive layer and sliding the centralizer relative to the tubular string after the screws have been loosened so that the centralizer can be removed therefrom. In the preferred embodiment the step of heating is performed until a temperature of approximately 600° F. is reached; more generally, the substance of the adhesive layer should be of a type which maintains the rigid bond at the temperature to be encountered in the well.

Although not illustrated, still another embodiment of the present invention includes two collar stops having annular or sleeve-like constructions of types as known to the art. Each collar stop is located adjacent a respective end of the collar or sleeve 6 in a manner also as known to the art. In this embodiment the adhesive is applied between the collar stops and the tubular string instead of between the collar 6 and the string. Set screws or other mechanical fastening means are used with the collar stops in a manner similar to their usage with the collar 6 of the previously described embodiments. From this construction it is apparent that the collar 6 is maintained in a similar rigid or fixed longitudinal position relative to the tubular string, but it is relatively free to rotate relative to the string. Therefore, this alternate embodiment still provides an apparatus coupled to a tubular string so that it will not slip off when acted upon by forces within a well bore.

Thus, the present invention provides a technique by which positive centralization can be achieved with a structure that also imparts a turbulent action to a cement slurry. The preferred embodiment also includes structure to clean wall cake from the well bore as the tubular string is lowered into the well bore. By the present invention a bond between at least part of the object and the tubular string is achieved to prevent at least longitudinal movement between the object and the tubular string in response to pressures and movements encountered in the well bore, but which object can be removed by externally applying heat to the connection.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts and the performance of steps can be made by those skilled in the art, which changes are encompassed within the spirit of this invention as defined by the appended claims.

What is claimed is:

1. A method of attaching an object to a tubular member between the connecting ends thereof for use in a well bore, comprising:

disposing the object around the tubular member so that a space is defined between the object and the tubular member;

injecting an adhesive substance into the space for rigidly bonding the object and the tubular member; and tightening a plurality of screws through the object into engagement with the tubular member.

2. A method of using a centralizer with a liner to be disposed in a well bore, comprising:

sliding a centralizer onto the liner, the centralizer having a plurality of sets of threaded holes defined therethrough, each of the sets having the holes substantially linearly aligned;

injecting an adhesive substance through at least one of the holes so that an adhesive layer is formed between the centralizer and the liner;

rotating the centralizer during the step of injecting; and tightening set screws, received in the holes, against the liner.

3. A method as defined in claim 2, further comprising:

heating the adhesive layer; and sliding the centralizer off of the liner.

4. A method as defined in claim 3, wherein the step of heating includes heating to a temperature of approximately 600° F.

5. A method as defined in claim 2, wherein the substantially linear alignments of the holes extend obliquely relative to longitudinally spaced ends of the centralizer.

6. A method as defined in claim 2, wherein said step of injecting includes attaching a caulking-type gun to one of the holes and actuating the caulking-type gun to dispense a flow of liquid metal compound contained therein.

7. A method of using a centralizer with a tubular member to be disposed in a well bore, comprising:

sliding a centralizer onto the tubular member, the centralizer having a plurality of sets of threaded holes defined therethrough, each of the sets having the holes substantially linearly aligned;

injecting an adhesive substance through at least one of the holes so that an adhesive layer is formed between the centralizer and the tubular member;

rotating the centralizer during the step of injecting; and tightening set screws, received in the holes, against the tubular member.

8. A method of using a centralizer with a tubular member to be disposed in a well bore, comprising:

sliding a centralizer onto the tubular member, the centralizer having holes defined therethrough;

applying an adhesive substance between the centralizer and the tubular member so that an adhesive layer providing an engagement force connecting the centralizer to the tubular member is formed; and tightening screws through the holes in the centralizer towards the tubular member so that a further engagement force connecting the centralizer to the tubular member is provided.

9. A method of using a centralizer with a tubular member to be disposed in a well, comprising:

sliding a centralizer onto the tubular member, the centralizer having a plurality of sets of holes defined therethrough, each of the sets having the holes substantially linearly aligned;

applying an adhesive substance between the centralizer and the tubular member so that an adhesive layer is formed between the centralizer and the tubular member; and tightening set screws, received in the holes, against the tubular member.

10. A method of using a centralizer with a tubular member to be disposed in a well, comprising:

sliding a centralizer onto the tubular member, the centralizer including a collar and a plurality of turbulizer blades extending radially outwardly from the collar;

applying an adhesive substance between the centralizer and the tubular member so that an adhesive layer is formed between the centralizer and the tubular member for rigidly bonding the centralizer and the tubular member; and tightening screws through holes defined through the turbulizer blades and the collar towards the tubular member for connecting the centralizer to the tubular member.

* * * * *